US008101086B2

(12) United States Patent
Varadaraj et al.

(10) Patent No.: US 8,101,086 B2
(45) Date of Patent: Jan. 24, 2012

(54) OIL/WATER SEPARATION OF FULL WELL STREAM BY FLOCCULATION-DEMULSIFICATION PROCESS

(75) Inventors: Ramesh Varadaraj, Flemington, NJ (US); Lee A. Littlejohn, Humble, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 566 days.

(21) Appl. No.: 12/305,642

(22) PCT Filed: Jun. 14, 2007

(86) PCT No.: PCT/US2007/013899

§ 371 (c)(1),
(2), (4) Date: Dec. 18, 2008

(87) PCT Pub. No.: WO2008/020907

PCT Pub. Date: Feb. 21, 2008

(65) Prior Publication Data

US 2009/0200213 A1 Aug. 13, 2009

Related U.S. Application Data

(60) Provisional application No. 60/838,016, filed on Aug. 16, 2006.

(51) Int. Cl.
*C02F 1/52* (2006.01)
*C02F 1/56* (2006.01)
*B01D 17/05* (2006.01)

(52) U.S. Cl. ..... 210/708; 166/267; 175/66; 208/188; 210/727; 210/737; 210/748.01; 210/748.07

(58) Field of Classification Search ..... 210/708
See application file for complete search history.

(56) References Cited

U.S. PATENT DOCUMENTS

| | | | | |
|---|---|---|---|---|
| 3,267,998 | A | 8/1966 | Simpson | |
| 3,756,959 | A | 9/1973 | Vitalis et al. | |
| RE29,908 | E | 2/1979 | Fowler et al. | |
| 4,160,742 | A | 7/1979 | Raman | |
| 4,466,885 | A * | 8/1984 | Ronden | 208/188 |

(Continued)

FOREIGN PATENT DOCUMENTS

WO WO 2005/113726 A1 12/2005

(Continued)

OTHER PUBLICATIONS

Deng, S. et al., "Destabilization of oil droplets in produced water from ASP flooding", *Colloids and Surfaces A*: Physicochem. Eng. Aspects 252, 2005, pp. 113-119, Elsevier Science Ltd., UK.

(Continued)

*Primary Examiner* — Peter A Hruskoci
(74) *Attorney, Agent, or Firm* — ExxonMobil Upstream Research Company-Law Department

(57) ABSTRACT

A process for the separation of production fluids is provided. The production fluids comprise an oil/water emulsion stabilized with fine solids. The emulsion may further comprise asphaltenes and naphthenic acids and resins. The process includes subjecting the emulsion to a flocculating agent to flocculate solids within the emulsion, and separating water and solids from crude oil in a first separator. The process further includes subjecting the separated crude oil to a demulsifier after subjecting the emulsion to a flocculating agent, and further separating water from the crude oil in a second separator. A process for producing fluids from a hydrocarbon-bearing reservoir is also provided, using the separation processes herein.

64 Claims, 2 Drawing Sheets

U.S. PATENT DOCUMENTS

| | | | | | |
|---|---|---|---|---|---|
| RE31,900 | E | | 5/1985 | Halverson | |
| 4,686,066 | A | | 8/1987 | Hofinger et al. | |
| 4,734,205 | A | * | 3/1988 | Jacques et al. | 210/708 |
| 4,797,214 | A | * | 1/1989 | Sevier | 210/651 |
| 4,938,876 | A | | 7/1990 | Ohsol | |
| 4,961,858 | A | * | 10/1990 | Spei et al. | 210/708 |
| 5,045,212 | A | | 9/1991 | Augustin et al. | |
| 5,354,477 | A | | 10/1994 | Rush | |
| 5,433,863 | A | * | 7/1995 | Braden et al. | 210/708 |
| 5,643,460 | A | * | 7/1997 | Marble et al. | 210/705 |
| 5,985,137 | A | | 11/1999 | Ohsol et al. | |
| 6,039,880 | A | * | 3/2000 | Morataya | 210/708 |
| 6,077,400 | A | | 6/2000 | Kartchner | |
| 6,086,830 | A | | 7/2000 | Kartchner | |
| 6,168,702 | B1 | | 1/2001 | Varadaraj et al. | |
| 6,189,613 | B1 | | 2/2001 | Chachula et al. | |
| 6,489,368 | B2 | | 12/2002 | Varadaraj et al. | |
| 6,491,824 | B1 | | 12/2002 | Lin et al. | |
| 6,555,009 | B2 | | 4/2003 | Varadaraj | |
| 6,599,949 | B2 | | 7/2003 | Varadaraj et al. | |
| 6,716,358 | B2 | | 4/2004 | Varadaraj | |
| 7,014,773 | B2 | | 3/2006 | Varadaraj | |
| 7,070,696 | B2 | | 7/2006 | Weir et al. | |
| 2004/0014821 | A1 | | 1/2004 | Varadaraj | |
| 2005/0258071 | A1 | | 11/2005 | Varadaraj et al. | |
| 2006/0183950 | A1 | | 8/2006 | Varadaraj et al. | |

FOREIGN PATENT DOCUMENTS

| | | | |
|---|---|---|---|
| WO | WO 2005/113727 | A2 | 12/2005 |
| WO | WO 2008/020908 | A2 | 2/2008 |
| WO | WO 2008/020909 | A2 | 2/2008 |

OTHER PUBLICATIONS

Gallup, D. L. et al., "West Seno Deepwater Development Case History-Production Chemistry", SPE 92969, SPE International Symposium on Oilfield Chemistry, Feb. 2-4, 2005, pp. 1-13, Houston, TX.

Grant, C. et al., "Long Distance Pipelining of Bitumous Froth", 47$^{th}$ Annual Technical Meeting of the Petroleum Society, Jun. 10-12, 1996, pp. 1-22, Calgary, AB, Canada.

Holloway, F. H., "The chemical treatment of offshore oil and gas production", SPE 6678, 1977, pp. 1-10.

Khan, Z. H. et al., "Improvement of the quality of heavily weathered crude oils", *Fuel*, 1995, pp. 1375-1381, v. 74 No. 9, Elsevier Science Ltd., UK.

Kokal S. et al., "Oil-Water Separation Experience from a Large Oil Field", SPE 93386, 14$^{Th}$ SPE Middle East Oil & Gas Conference, Mar. 12-15, 2005, pp. 1-9, Bahrain.

Mohtadi, M. F. et al., "Effect of Temperature on Flocculation of Aqueous Dispersions", *Water Research Pergamon Press*, 1973, pp. 747-767, v. 7, UK.

Peigne, G. et al., "Improving the Pumping of Viscous Oil by the Use of Demulsifiers or by an Annular Water Injection", 1998, 20$^{th}$ Annv. Oil Spill Conference, pp. 175-180, San Antonio, TX.

Varadaraj, R. et al., "Molecular Origins of Heavy Crude Oil Interfacial Activity, Part 1: Fundamental Interfacial Properties of Asphaltenes Derived from Heavy Crude Oils and Their Correlation to Chemical Composition", Energy & Fuels, 2007, pp. 195-198, v 21, Washington, DC.

Varadaraj, R. et al., "Molecular Origins of Heavy Crude Oil Interfacial Activity, Part 2: Fundamental Interfacial Properties of Model Naphthenic Acids and Naphthenic Acids Separated from Heavy Crude Oils", Energy & Fuels, 2007, pp. 199-204, v 21, Washington, DC.

Varadaraj, R. et al., "Molecular Origins of Heavy Crude Oil Interfacial Activity, Part 3: Characterization of the Complex Fluid Rag Layer Formed at Crude Oil-Water Interfaces", Energy & Fuels, 2007, pp. 1617-1621, v 21, Washington, DC.

Yang, M. et al., "Interactions Between Chemical Additives and Their Effects on Emulsion Separation", SPE 36617, SPE Annual Technical Conference, Oct. 6-9, 1996, pp. 453-463, Denver, CO.

European Search Report No. 114398, Apr. 13, 2007, 1 page.

* cited by examiner

OIL/WATER SEPARATION OF FULL WELL STREAM BY FLOCCULATION-DEMULSIFICATION PROCESS

CROSS REFERENCE TO RELATED APPLICATIONS

This application is the National Stage of International Application No. PCT/US2007/013899, filed 14 Jun. 2007, which claims the benefit of U.S. Provisional Application No. 60/838,016, filed 16 Aug. 2006.

BACKGROUND OF THE INVENTION

1. Field of the Invention

The present invention relates to the field of fluid separation. More specifically, the present invention relates to the separation of oil and water in connection with hydrocarbon production activities.

2. Background of the Invention

Effective separation of water from produced crude oil is a continuing need for the oil industry. Effective separation is particularly useful during the early stages of production from a well when there may be high water content. Even in wells that do not have significant initial water production, water cuts can increase over the life of a well to the point where the production fluids have to be treated to remove water.

When water is produced with oil it is frequently in the form of an emulsion. An emulsion is a heterogeneous liquid system involving two immiscible liquids, with one of the liquids being intimately dispersed in the form of droplets in the second liquid. The matrix of an emulsion is called the external or continuous phase, while the portion of the emulsion that is in the form of small droplets is called the internal, dispersed, or discontinuous phase.

The stability of an emulsion is generally controlled by the type and amount of surface-active agents present. In some instances, particularly with heavy oils, finely divided mineral solids existing within the production stream can act as emulsifying agents. The emulsifying agents form interfacial films around the droplets of the dispersed phase and create a barrier that slows down or inhibits coalescence of the water droplets.

The tendency of heavy oils to contain water-in-oil emulsions is attributable to the presence of certain hydrocarbon molecules sometimes found in heavy crudes. Particularly, high naphthenic acid and asphaltene content crude oils possess the tendency to form stable, water-in-crude oil emulsions. The polar naphthenic acids and asphaltenes in crude oil stabilize dispersed water droplets. Further, sub-micron sized solids like silica and clay, when present in the crude oil, interact with the polar acids and asphaltenes to enhance the stability of the emulsions. Formation of stable water-in-crude emulsions results in difficulty in separating water from the crude oil.

For bitumen produced from oil sands, both water and solids result from the oil sands extraction process. This means that solids are also separated from the crude oil. Crude oil dehydration treating systems are typically used to reduce the basic sediment and water (BS&W) out of crude oil to the acceptable level specified by a crude oil purchaser, such as a pipeline company. The level of sediment and water typically specified by purchasers is less than 1%.

It has been known to separate water from crude oil using settling tanks and mechanical separators. However, when water forms a stable emulsion with crude oil, the use of storage or settling tanks and mechanical separators may fail to provide the separation desired. Emulsions of heavy oil and water produced from a reservoir formation can contain from about 1% to about 60% water by volume. A common range of emulsified water in crude oils heavier than 20° API is from 10% to 35%.

In an effort to further separate produced water from crude oil, it is also known to treat the well stream (i.e. the production fluids) with chemicals. These chemicals are referred to as dehydration chemicals or demulsifiers. Demulsifiers allow the dispersed droplets of the emulsion to coalesce into larger drops and settle out of the matrix. For example, U.S. Pat. No. 5,045,212; U.S. Pat. No. 4,686,066; and U.S. Pat. No. 4,160,742 disclose examples of chemical demulsifiers used for breaking emulsions. In addition, commercially available chemical demulsifiers, such as ethoxylated-propoxylated phenolformaldehyde resins and ethoxylated-propoxylated alcohols, are known for demulsification of crude oils. Such demulsifiers further minimize the amount of heat and settling time otherwise required for separation. However, the effectiveness of these demulsifiers on heavy crude oils, particularly those containing asphaltenes, naphthenic acids and inorganic solids may be limited.

Where the crude oil is heavy oil, it is typical to also employ electrostatic separators. Gravity settling and centrifugation in conjunction with chemical demulsifiers have also been employed.

It is also a known practice to increase the temperature of operation of separators in an attempt to break water/oil emulsions. U.S. Pat. No. 4,938,876 (herein referred to as the '876 patent) discloses a method for separating oil, water and solids from emulsions by heating the emulsion to about 115° C., rapidly cooling the mixture to below 100° C., separating the solids from the liquids and then separating the water from the oil. The '876 patent describes applying "an effective amount of a surfactant as a demulsifying agent" before heating. The patent further discloses the addition of a flocculant prior to cooling the mixture.

In some known technologies for breaking emulsions, an intermediate emulsion rag layer is produced. Further processing of the rag layer may be utilized to recover the crude oil and discharge the water. Recently, a microwave technology has been disclosed in U.S. Pat. Nos. 6,086,830 and 6,077,400. This microwave technology uses microwaves to treat hard-to-treat emulsions, especially for the rag layer. Other fluid treatment processes have been in U.S. Pat. No. 6,189,613 and U.S. Pat. No. 6,491,824.

There remains a need for improved demulsification processes for oil/water emulsions, such as heavy crude oil emulsions and bitumen emulsions. There is also a need for an improved fluid separation process in which a flocculant is applied to the well stream, followed by a demulsification and separation process. A need also exists for improved demulsification of heavy crude oils stabilized by solids-crude oil polar complexes.

SUMMARY OF THE INVENTION

The benefits and advantages of the present invention are achieved by an improved process for oil/water separation of oil well production fluids. The production fluids define an oil/water emulsion stabilized with fine solids. The emulsion may further comprise asphaltenes and naphthenic acids and resins.

Generally, the separation process includes subjecting the emulsion to a flocculating agent to flocculate solids within the emulsion. The emulsion is then carried through a first separator to separate at least some water and solids from the crude oil. The process further includes subjecting the separated crude oil to a demulsifier after subjecting the emulsion to the flocculating agent, and then separating additional water from crude oil in a second separator. The separation process may further include the step of processing the crude oil released from the second separator through a third separator.

Subjecting the emulsion to a flocculating agent may be conducted by injecting the flocculating agent down the wellbore. In one aspect, the flocculant is further injected into a hydrocarbon-bearing reservoir around the wellbore. Alternatively, subjecting the emulsion to a flocculating agent may be conducted by mixing the flocculating agent with the oil/water emulsion at a surface facility. In this instance, separating water and solids from crude oil in a first separator is also conducted at the surface facility.

Subjecting the crude oil to a demulsifier may be conducted by mixing a demulsifier into the separated crude oil before the emulsion enters the second separator. Alternatively, subjecting the separated crude oil to a demulsifier may be conducted by mixing the demulsifier into the crude oil within the second separator. Preferably, the temperature of operation in the second separator is in a range wherein the demulsifier function does not act as a dispersant. In one embodiment, the operating temperature of the second separator is between about 25° Celsius (C) and about 70° C. In another embodiment, the operating temperature of the first separator is also between about 25° C. and about 70° C. In one aspect, the operating pressure of the second separator is between ambient pressure and about 200 pounds per square inch gauge (psig) or 1480.4 kilo Pascal (kPa).

The flocculating agent may be an inorganic salt. For instance, the flocculating agent may be aluminum sulfate, ferric chloride, or mixtures thereof. In another example, the flocculating agent may be a cationic polymer, an anionic polymer, or mixtures thereof. Preferably, the flocculating agent is delivered by an aqueous delivery medium.

Various dosages of the flocculating agent may be used. For instance, subjecting the emulsion to a flocculating agent may be conducted by mixing the flocculating agent with the oil/water emulsion at the surface facility, with the dosage of flocculating agent being between about 5 parts per million (ppm) to about 1,000 ppm based on the weight of the emulsion. In another instance, the flocculating agent is delivered into the wellbore by an aqueous delivery medium, and the dosage of flocculating agent into the wellbore is between about 20 ppm to about 2,000 ppm based on the weight of the delivery medium.

Various demulsifiers may be used in different embodiments. In one aspect, the demulsifier is comprised of one or more ethyleneoxy-propyleneoxy (EO-PO) polymers as a demulsifier active ingredient. In another aspect, the demulsifier is selected from ethoxylated-propoxylated phenolformaldehyde resins and ethoxylated-propoxylated alcohols. The demulsifier may be present in the range from about 0.1 weight (wt.) % to about 5.0 wt. % based on the amount of the separated crude oil.

A delivery solvent may also be mixed with the demulsifier before treating the separated crude oil. The solvent may be, for instance, crude oil distillates boiling in the range of about 70° C. to about 450° C. The delivery solvent is selected from the group consisting of crude oil distillates, alcohols, ethers, or mixtures thereof. In one embodiment, the delivery solvent is present in an amount of from about 35 wt. % to about 75 wt. % in the demulsifier, such weight percentage being included in the 0.1 wt. % to 5.0 wt. % demulsifier added to the separated crude oil.

A process for producing fluids from a hydrocarbon-bearing reservoir is also provided. In one embodiment, the process includes moving production fluids from the reservoir into a wellbore, the production fluids comprising a crude oil/water emulsion stabilized at least in part by solids. From there, the production fluids are moved through the wellbore to a surface facility. The process further includes subjecting the production fluids to a flocculating agent to flocculate solids within the emulsion, separating water and solids in the emulsion from crude oil in a first separator, subjecting the separated crude oil to a demulsifier after subjecting the emulsion to the flocculating agent, and separating additional water from crude oil in a second separator. In one aspect, the method further comprises processing the crude oil released from the second separator through a third separator.

The second separator operates in a temperature range wherein the demulsifier does not act as a dispersant. Preferably, the operating temperature of the second separator is between about 25° C. and about 75° C., or more preferably between about 50° C. and about 70° C. Further, the operating temperature of the second separator may be about 15° C. to about 50° C. below an operating temperature of the first separator.

In one aspect, subjecting the emulsion to a flocculating agent is conducted by injecting the flocculating agent down a wellbore. Further, separating water and solids from crude oil in a first separator is conducted at a surface facility. Still further, subjecting the emulsion to a flocculating agent is conducted by mixing the flocculating agent with the oil/water emulsion at the surface facility.

The flocculating agent may be an inorganic salt. The flocculating agent may be a cationic polymer, an anionic polymer, or mixtures thereof. In one aspect, subjecting the emulsion to a flocculating agent is conducted by mixing the flocculating agent with the oil/water emulsion at the surface. In this instance, the dosage of the flocculating agent put into the wellbore is between about 5 ppm to about 1,000 ppm based on the weight of the emulsion. In another aspect, the flocculating agent is delivered into the wellbore by an aqueous delivery medium. In this instance, the dosage of flocculating agent into the wellbore is between about 20 ppm to about 2,000 ppm based on the weight of the delivery medium.

In one embodiment, subjecting the crude oil to a demulsifier comprises mixing a demulsifier into the separated crude oil before the crude oil enters the second separator. The demulsifier may be comprised of one or more ethyleneoxy-propyleneoxy (EO-PO) polymers as a demulsifier active ingredient. For example, the demulsifier may be selected from ethoxylated-propoxylated phenolformaldehyde resins and ethoxylated-propoxylated alcohols. In one aspect, the demulsifier is in the range from about 0.1 wt. % to about 5.0 wt. % based on the amount of the separated crude oil.

The demulsifier may be mixed with a delivery solvent before treating the separated crude oil. In one aspect, the delivery solvent is present in an amount of from about 35 wt. % to about 75 wt. % in the demulsifier, such weight percentage being included in the 0.1 wt. % to 5.0 wt. % demulsifier added to the separated crude oil.

In any of the methods, the emulsion is typically, though not necessarily, a water-in-oil emulsion. The oil is typically, though not necessarily, a heavy oil. The emulsion may contain dissolved inorganic salts of chloride, sulfates or carbonates of Group I and II elements of the long form of The Periodic Table of Elements.

In any of the methods, the stabilizing solids in the emulsion may comprise at least one of formation fines, drilling muds and completion fluids. For instance, the solids may comprise fine solids with diameters from about 0.5 microns to about 100 microns. The solids may comprise at least one of silica and clay.

In any of the methods, the production fluids may comprise one or more of asphaltenes, naphthenic acid compounds, resins, and mixtures thereof.

In any of the methods, the separators may be any one of a number of different types of separators. For instance, the first separator may be at least one of a centrifugation separator, a gravity settling separator, a hydrocyclone, a separator that applies an electrostatic field, and a separator that applies microwave treatment. Similarly, the third separator may be at least one of a centrifugation separator, a gravity settling separator, a hydrocyclone, a separator that applies an electrostatic field, and a separator that applies microwave treatment.

BRIEF DESCRIPTION OF THE DRAWINGS

So that the manner in which the features of the present invention can be better understood, certain drawings, charts and flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

As used herein, the term "demulsification" refers to an action by a demulsifier to attract water droplets, and bring them together. The terms "demulsifier" means any surface active agent that acts to separate water from oil, and to cause water droplets to be attracted to one another.

The terms "emulsion" and "oil/water emulsion" mean either a water-in-oil emulsion or an oil-in-water emulsion.

"Surface facility" means any facility configured to receive production fluids. The facility may be at or near the wellhead, or may be downstream. The facility may be on land, on a floating platform, or on a vessel.

"Hydrocarbons" are organic material with molecular structures containing carbon and hydrogen. Hydrocarbons may also include other elements, such as, but not limited to, halogens, metallic elements, nitrogen, oxygen, and/or sulfur.

"Oil" means a fluid containing a mixture of condensable hydrocarbons.

The term "heavy oil" refers to viscous hydrocarbon fluids, having a viscosity generally greater than about 100 centipoise at ambient conditions (15° C. and 1 atmosphere (atm) of pressure). Heavy oil generally has American Petroleum Institute (API) gravity below about 20° and most commonly about 10° to 20°. Heavy oil may include carbon and hydrogen, as well as smaller concentrations of sulfur, oxygen, and nitrogen. Heavy oil may also include aromatics or other complex ring hydrocarbons.

The terms "flocculant" or "flocculating agent" mean a compound that attracts solid particles and aggregates the solids to prevent dispersion within an emulsion.

The terms "production fluids" or "produced fluids" refer to fluids produced from a hydrocarbon-bearing formation. Such fluids may carry solid materials, and may include fluids and solids previously injected during drilling or well treatment. Such fluids may or may not contain organic acids, such as asphaltenes.

The term "bitumen" means any naturally occurring, non-crystalline solid or viscous hydrocarbon material that is substantially soluble in carbon disulfide.

The term "wellbore" refers to a hole in a formation made by drilling or insertion of a conduit into the formation. A wellbore may have a substantially circular cross section, or other cross-sectional shapes (e.g., circles, ovals, squares, rectangles, triangles, slits, or other regular or irregular shapes). As used herein, the terms "well" and "opening," when referring to an opening in the formation may be used interchangeably with the term "wellbore."

Description of Specific Embodiments

Figure 1:
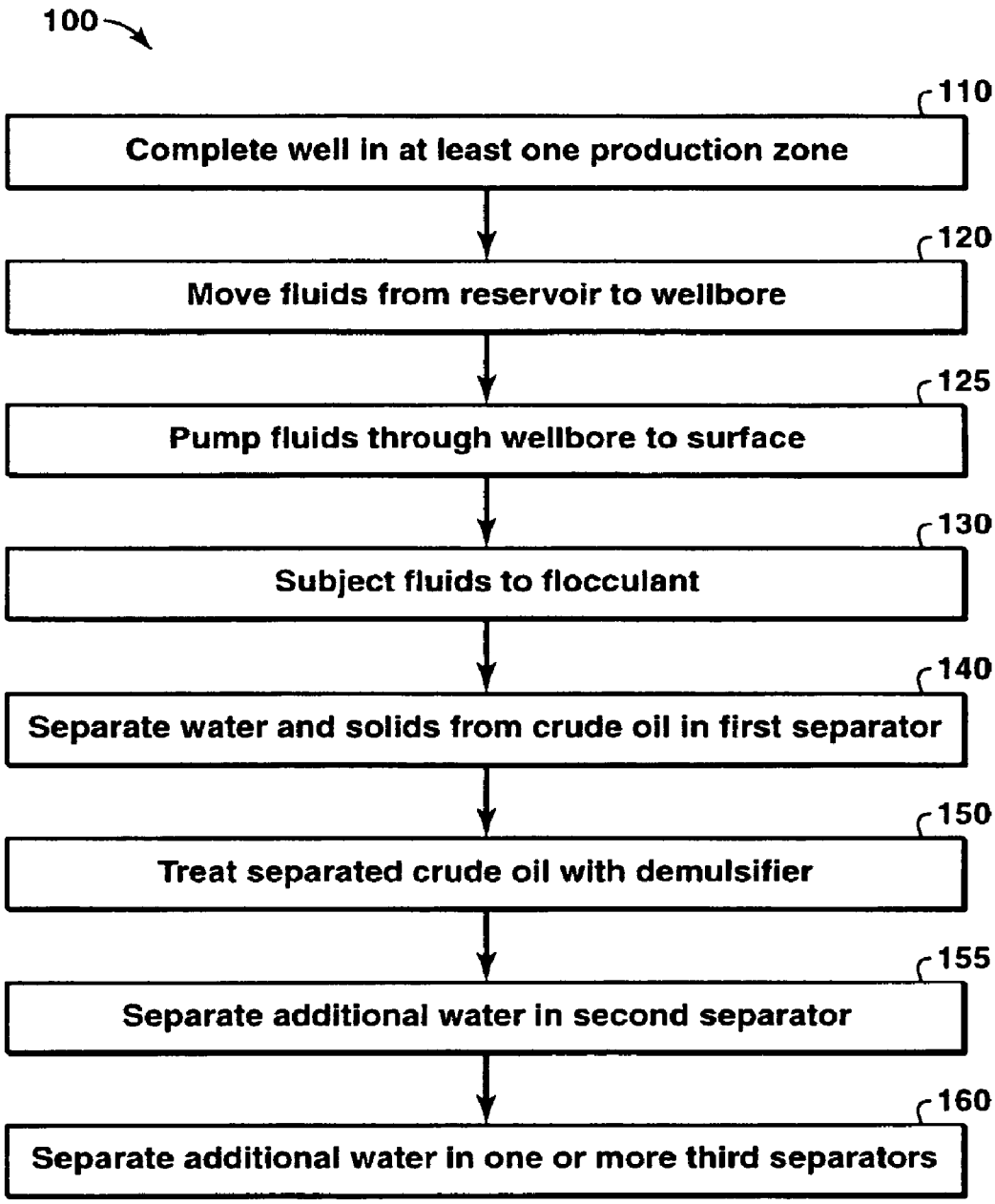
FIG. 1 presents a flow chart demonstrating a method of separating oil and water, in one embodiment.

A process for separating a crude oil/water emulsion from a flow of production fluids is provided. The flow of production fluids is typically from the wellbore. FIG. 1 presents a flow chart of a process 100 for separating oil and water, in one embodiment. The process 100 is applicable to any emulsion comprising water and oil, but preferably is used for the water-in-oil emulsions. The process 100 is particularly suitable where the crude oil is heavy oil. The process 100 is also particularly applicable to production fluids of heavy oil having organic acids such as one or more of asphaltenes, naphthenic acid compounds, resins, basic nitrogen compounds and mixtures thereof.

The process 100 is also preferred for water-in-oil emulsions stabilized at least in part by solids. When solids are present, they contribute to stabilizing the emulsion. Such emulsions may be referred to as solids-stabilized emulsions. The solids typically range from about 0.01 wt. % to about 5.0 wt. % of the well stream, such as a production stream. The solids, if present in the crude oil, are typically fine solids with diameters from about 0.5 microns to about 100 microns. Examples of solids include fine mineral particles, such as silica and clay. The solids may be other solids introduced during drilling operation or a well workover procedure. Typically, barium sulfate ($BaSO_4$) is used in drilling muds, and calcium carbonate ($CaCO_3$) may be introduced into the drilling operations in "kill-pills".

The aqueous phase of the emulsion comprises water. The water may constitute "brine," and may include dissolved inorganic salts of chloride, sulfates and carbonates of Group I and II elements of the long form of The Periodic Table of Elements. Organic salts can also be present in the aqueous phase. The process 100 is effective for crude oil emulsions that include brine.

Referring again to the process of FIG. 1, a wellbore is formed through the earth surface, as shown in block 110. The wellbore penetrates through various subterranean layers, including a hydrocarbon- or carbonaceous-bearing formation. The wellbore is completed in at least one production zone or subsurface reservoir. The process 100 is not limited by the manner in which the well is completed.

It may be desirable to produce the fluids from the hydrocarbon-bearing formation or reservoir. Accordingly, the production fluids are moved from the reservoir and into the wellbore, as shown in block 120. Further, the production fluids are pumped (or otherwise moved) to a surface facility, as represented in block 125.

It has been determined that when solids in the size range of 0.1 microns to 10 microns are present in crude oils, the polar components of crude oils, such as asphaltenes and naphthenic acids, tend to adsorb on the solid particles and form surface active solids-crude oil polars complexes. Therefore, as part of the process 100, and in accordance with the methods disclosed herein, the production fluids are treated with a flocculent. This is as shown in block 130.

The purpose of the flocculation step in block 130 is to flocculate the solids-crude oil polars complex to larger size particles. The larger size flocculants of the polar complex have less surface area and a lower tendency to aggregate at the oil/water interface. Further, the larger size flocculants enhance the phase separation of the solids out of the emulsion as supported by Stokes settling laws.

Figure 2:
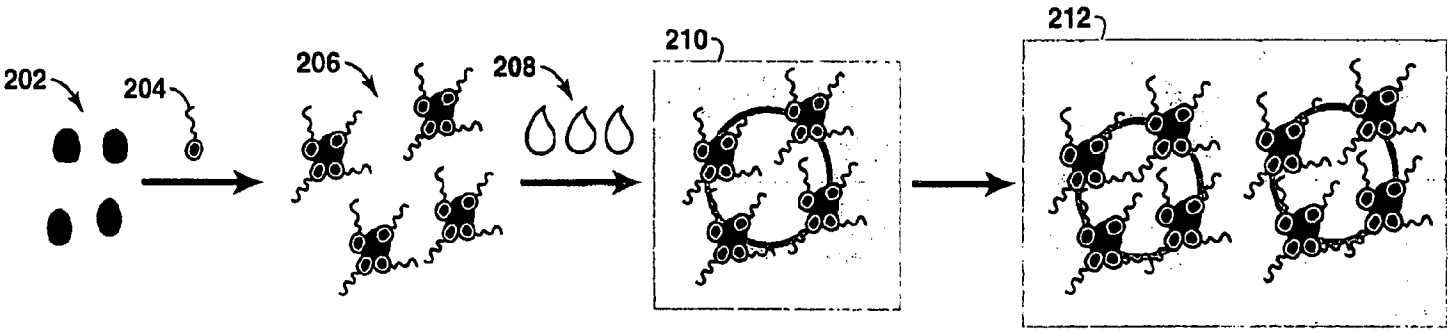
FIG. 2 provides a pictorial representation of one process by which the interaction between fine solids and crude oil polars results in decreased coalescence of water from oil.

FIG. 2 provides a pictorial representation of the process by which interaction between fine solids 202 and crude oil polars 204 results in decreased coalescence of water 208 from oil. It is shown in FIG. 2 that fine solids 202 interact with crude oil polars 204 to form solids-crude oil polars complexes 206. The complexes 206 reside at the water/oil interface 210 of a crude oil emulsion. When the surface active complexes 206 aggregate at the oil/water interface 210, they form a steric barrier 212 to water droplet coalescence. This steric barrier 212 results in a decrease in the efficiency of demulsifiers and oil/water separation. The solids 202 are believed to be the main contributor to the observed stability of the emulsions.

To more effectively break down emulsions, it was determined that some decrease in solids attrition is beneficial. Certain demulsifiers, such as those comprised of ethyleneoxy-propyleneoxy (EO-PO) polymers as the demulsifier active ingredient, are known to be effective for crude oil emulsions stabilized by crude oil polars and asphaltenes. However, they are not as effective for emulsions stabilized by solids-crude oil polars complexes 206. Therefore, it was determined that the use of a flocculant in the well stream before addition of a demulsifier may be advantageous. Stated another way, early removal of the surface active species assists in breaking stable emulsions.

Figure 3:
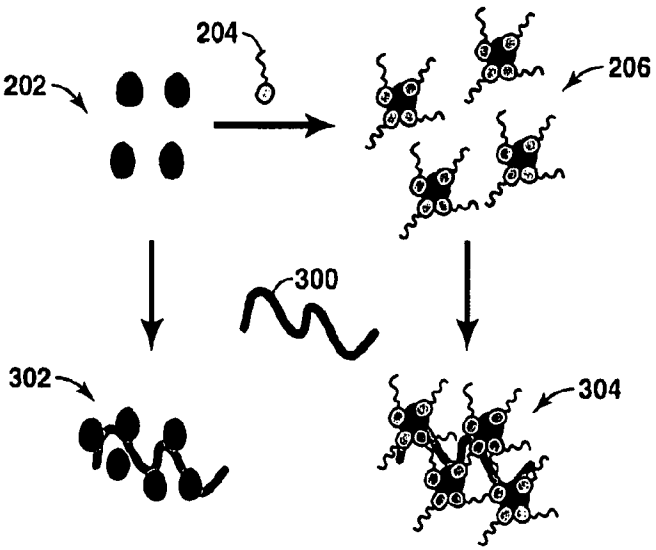
FIG. 3 provides a pictorial representation of one process by which a polymeric flocculant binds the solids and the solids-crude oil polar complexes into flocculated solids, allowing for increased coalescence of water from oil.

FIG. 3 provides a process of flocculating the emulsion (block 130). It is shown in FIG. 3 that fine solids 202 interact with crude oil polars 204 to again form solids-crude oil polars complexes 206. The complexes 206 seek to reside at the water/oil interface (210 of FIG. 2) of a crude oil emulsion. However, when a flocculant 300 is added, the flocculant 300 binds both the solids 202 and the solids-crude oil polars complexes 206 into larger flocculated solid particles 302 and complexes 304. The larger size flocculent solids 302 of the complex 304 have less surface area and a lower tendency to aggregate at the oil/water interface. Further, the larger size of the flocculants 302, 304 enhances the faster phase separation of the solids 302 out of the emulsion as supported by Stokes settling laws. Early removal of the surface active species can inhibit formation of the stable emulsions and, additionally, render more favorable conditions for the performance of chemical demulsifiers in other demulsification operations at the surface.

The flocculant treatment in block 130 may take place in one of several locations. First, the flocculation in block 130 may be applied to the well stream, such as the full well stream, when production fluids are brought from the wellbore and to the surface in block 125. For treatment of production fluids at the surface facility, the preferred range of dosage is between about 5 ppm to about 1,000 ppm based on the weight of the produced fluids. More preferably, the concentration is between about 200 ppm and about 1,000 ppm based on the weight of the produced fluids.

The flocculation in block 130 may alternatively be performed by injecting flocculant into the reservoir. In this instance, an injection line runs down the tubing-casing annulus under sufficient pressure to cause the flocculant to intermingle with reservoir fluids within the rock matrix. It is not necessary that the flocculant invade the formation more than a few centimeters. Any greater pressure may interfere with the production process.

Finally, the flocculation in block 130 is preferably conducted by injecting the flocculant into the wellbore. An injection line may be run down the tubing-casing annulus or in some manner external to the production tubing. Alternatively, an injection line may be run internal to the production tubing so long as it does not interfere with downhole equipment, such as valves, pumps and gauges. The injection line may or may not terminate at total depth. In one aspect, flocculant injection takes place at more than one depth of the tubing. In either aspect, the flocculant is injected into the wellbore without pressurizing it in a manner to cause it to invade the surrounding formation.

In either a downhole or surface treatment embodiment, the mode of delivery of the flocculant is preferably via an aqueous medium. Alternatively, the flocculant may be incorporated as a solid that is introduced to the production stream. It is preferable to deliver the flocculant in an aqueous medium to increase surface contact with water droplets.

Various flocculating agents may be used in block 130. In one aspect, the flocculating agent is an inorganic salt, such as aluminum sulfate and/or ferric chloride. In other aspects, cationic polymers, anionic polymers and mixtures thereof may be used. The concentration of the flocculant is preferably predetermined in laboratory screening experiments. The experiments apply various dosages of the flocculating agent to emulsions having the fine solids, e.g., 0.5 micron size silica, clay, $BaSO_4$ and $CaCO_3$. Determining an ideal concentration of the flocculant may enhance performance. A preferred range of dosage for wellbore injection is between about 20 ppm to about 2,000 ppm based on the weight of the delivery medium. More preferably, the range is from about 100 ppm to about 2,000 ppm based on the weight of an aqueous medium.

Treatment of the well stream (whether in the wellbore or at the surface) with the flocculating agent cause the flocculant to interact with solids particles in such a manner as to aggregate (or flocculate) the solids. Where a subsurface pump is used and where the flocculant is injected into the wellbore, it is preferred that the mixing forces experienced by the pumping of crude oil and water during uplift do not significantly contribute to solids breaking up into smaller particles. This is undesirable as it causes an increase in the solid particle surface area. Such a process of breaking up is known as solids attrition. Minimization of mixing forces experienced by the full well stream minimizes solids attrition and also lower the adsorption rate of the crude oil polars onto the solids surfaces while favoring solids flocculation.

Downhole injection of the flocculants is preferred to surface treatment of the produced emulsion. It is believed that the presence of the flocculant downhole not only prevents solids attrition, but actually causes the size and amount of aggregated or flocculated solids to increase during production in block 125. In this respect, the mixing energy caused by pumping or otherwise bringing the fluids up the production string may assist the flocculant in interacting with the solid particles so as to aggregate or flocculate the solids and increase the solid particle size.

After reaching the surface, the flocculant-treated fluid is directed to a first oil/water separator (i.e. first separator). This separator is preferably a conventional mechanical separator, such as an electrostatic or cyclone separator. Alternatively, a gravity settler, centrifugation, or microwave separator may be utilized. The first separator separates at least some of the water and flocculated solids from the crude oil, as shown in block 140. In one embodiment, the operating temperature of the first separator is between about 25° C. and about 70° C., or between about 40° C. and about 70° C.

At block 150, the oil emerging from the first separator is next treated with a demulsifier. The demulsification in block 150 causes water molecules entrained or dispersed in oil to coalesce and form larger water droplets. The demulsifier is added to the emulsion either as it exits the first separator, or within the chamber of a second separator. The use of the second separator for the separated crude oil is represented in block 155. The removal of the solids-polar complexes in block 130 and the removal of the solids in the first separator (block 140) provide a more favorable condition for the demulsifier (block 150) to effect oil/water separation.

Demulsifiers utilized in the present techniques may be any demulsifier used in oil/water demulsification. Particularly preferred demulsifiers are those comprised of ethyleneoxy-propyleneoxy (EO-PO) polymers as the demulsifier active ingredient. Such EO-PO polymeric demulsifiers are known to be effective for crude oil emulsions stabilized by crude oil polars and asphaltenes. However, they are not as effective for emulsions stabilized by solids-crude oil polars complexes.

Another chemical demulsifier that may be employed is a phenolformaldehyde ethoxylated alcohol having the chemical structure:

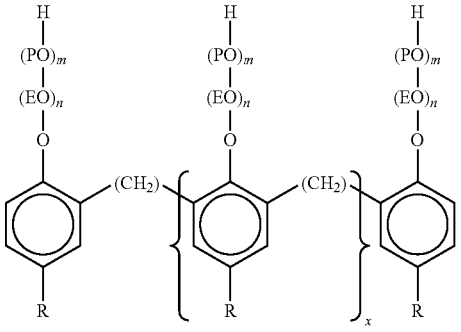

wherein:

R is selected from the group consisting of alkanes or alkenes from 8 to 20 carbons, E is $CH_2$—$CH_2$, P is $CH_2$—CH—$CH_3$, n ranges from 1 to 5, m ranges from 0 to 5, and x ranges from 3 to 9.

The amount of demulsifier to be used ranges from about 0.1 wt. % to about 5.0 wt. % based on the amount of the crude oil. Additionally, a delivery solvent may be employed. Such solvents may include crude oil distillates boiling in the range of about 70° C. to about 450° C. Solvents may also include alcohols, ethers and mixtures thereof. The delivery solvent is present in an amount of from about 35 wt. % to about 75 wt. % in the demulsifier. Thus, when utilized, the delivery solvent is included in the about 0.1 wt. % to about 5.0 wt. % demulsifier added to the crude oil-water mixture coming out of the first separator (block 140).

The temperature at which the separation process in block 155 is conducted in the second separator may be a variable in the effectiveness of the process. The temperature of operation should preferably be in the range wherein the demulsifier function does not act as a dispersant. Preventing the alteration of function of the demulsifier from demulsification to dispersancy through temperature control is one aspect of the disclosed methods. Therefore, it is desirable to conduct the second separation in block 155 at a temperature about 15° to about 50° C. lower than the typical temperature of 90° C.

Demulsifiers comprised of the preferred EO-PO polymers exhibit a unique inversion of function from demulsification to dispersion with increase in temperature. Such an inversion of function can have a negative impact on separation. Thus, in one embodiment of the invention the performance inversion temperature of the oil/water emulsion in the presence of the demulsifier is predetermined and the temperature of separation is chosen such that it is below the inversion temperature. Preferably, the second separation is in the temperature range wherein the temperature is below the demulsifier performance inversion temperature. More preferably, the second separation (block 155) is at a temperature between about 25° C. and about 70° C., or between about 50° C. and about 70° C. Further, the operating temperature of the second separator may be about 15° C. to about 50° C. below an operating temperature of the first separator.

Following demulsifier treatment in block 150 and second water separation in block 155, the separated crude oil may be subjected to one or more additional separation methods. This further separation step is represented in block 160. Such separation methods for block 160 may be any methods known in the art, including centrifugation, gravity settling, hydrocyclones, application of an electrostatic field, microwave treatment or combinations thereof. Any other methods known to the skilled artisan for phase separation may be employed.

Where centrifugation separation is utilized, centrifugation can be conducted at a relative centrifugal force of 500 to 150,000 g (acceleration due to gravity) for about 0.1 hour to about 6 hours or more. Where application of an electrostatic field is provided, the application is preferably about 500-5,000 volts/inch for about 0.1 hour to about 24 hours or more. An electrostatic separator may optionally be used to achieve further separation of water from oil. The third separator process in block 160 may be conducted at temperatures of the water-in-oil emulsion of about 20° C. to about 200° C. and at pressures from ambient to about 200 psig (about 1480.4 kPa).

After separation in blocks 140, 155, and 160, the oil may be recovered as a separate phase and delivered into a pipeline or storage facility for future transportation, refining, or sale.

EXPERIMENTAL

Laboratory experiments were conducted to demonstrate demulsification effectiveness of flocculant-demulsifier treatment to separate crude oil-water mixtures.

Example 1

Demulsifier Only Treatment

An emulsion sample (referred to as Sample #1) was made by mixing in a Silverson mixer at 1,000 revolutions per minute (rpm):

75 grams of Gryphon crude oil, 6 milliliter (ml) of water, 0.03 grams $BaSO_4$, 0.03 grams $CaCO_3$, and 0.01 grams bentonite clay.

Thereafter, Pluronic®-F127 was added to the emulsion. Pluronic®-F127 is an ethoxylated propoxylated alcohol demulsifier manufactured by BASF Corporation. The demulsifier was mixed into the emulsion at 200 rpm and subjected to electrostatic demulsification. The treat rate for the demulsifier (0.0075 grams) was 0.01 wt. % of actives based on the weight of the emulsion. Electrostatic demulsification was then conducted at 70° C. and 830 volts/inch potential for 30 minutes using a laboratory electrostatic coalescer. The amount of water separated out of the Sample #1 emulsion was 8.3% by weight.

Example 2

Flocculant Plus Demulsifier Treatment

An emulsion sample (referred to as Sample #2) was made by mixing in a Silverson mixer at 1,000 rpm:

75 grams (g) of Gryphon Crude oil, 6 ml of water, 0.03 grams $BaSO_4$, 0.03 grams $CaCO_3$, 0.01 g bentonite clay, and Tramfloc-364 flocculant (cationic polyacrylamide).

The treat rate for the flocculant was (0.0075 grams) at 0.01 wt. % based on the weight of the emulsion. Thereafter, Pluronic®-F127 demulsifier was added to the emulsion and mixed at 200 rpm. The treat rate for the demulsifier (0.0075 grams) was 0.01 wt. % of actives based on the weight of the oil. The emulsion was also subjected to electrostatic demulsification. Electrostatic demulsification was conducted at 70° C. and 830 volts/inch potential for 30 minutes using a laboratory electrostatic coalescer. The amount of water separated out of the emulsion of Sample #2 was 83% by weight.

As can be seen, the amount of water separated from Sample #2 is much greater than that separated from Sample #1, even up to ten-fold. Therefore, it can be concluded that by first treating an emulsion with a flocculant followed by the demulsifier, the demulsification performance is improved.

Example 3

Field Example from an Offshore Oil Field

Example 3 relates to emulsion problems encountered in the offshore operations. During 2005, emulsion problems appeared at a production facility in an offshore oil field. Two large parallel electrostatic coalescers in place at the production facility failed to separate water from produced crude oil. This resulted in curtailed production to a terminal.

External scanning of the coalescers was conducted to determine the internal state of the equipment. Scanning revealed that mud and sludge ("contaminated" sand) had deposited on the bottom of vessels and on electrodes. The coalescers were cleaned using high pressure flushing. As a result, 39 cubic meters ($m^3$) of sludge and materials was removed from the vessels to place the coalescers back on line and in accordance with the exportation specifications (including less than 0.5% water). Further, additional jetting nozzles were installed in the coalescers and periodic jetting routines were established.

In addition, laboratory work was initiated to help in understanding emulsion formation and treatment. Analysis of the emulsion layer in the coalescers demonstrated the presence of $BaSO_4$, $CaCO_3$, silica ($SiO_2$), and traces of clay. Particles were in relatively small amounts (less than 0.1%), and the size was generally less than 0.5 micrometers. Furthermore, the chemical treatment process was reviewed with a goal to determine the impact of naphthenic acids on emulsion stabilization, the impact of particulates size and makeup on emulsion stability, and the appropriateness of emulsifiers for successful treatment of the emulsion.

It was determined that the primary contributor to the emulsion formation and stability in the produced full well stream at the production facility was the presence of fine solids. Drilling mud solids are significantly larger in size (>100 microns) than the observed 0.5 micron average diameter of the solids in the produced full well stream. This indicated that the $BaSO_4$ and $CaCO_3$ solids remaining in the wellbore had undergone significant attrition due to the shearing forces experienced during production operations. The shearing activity most likely was experienced in the wellbore during pumping, although some shearing may have taken place during injection through the drilling assembly during wellbore formation.

The chemical composition of the produced oil also indicated the presence of polar components, i.e., naphthenic acids and resins and relatively small amounts of asphaltenic compounds. It was not believed that the crude oil polar species by themselves contribute to the stability of the crude emulsions. However, the adsorption of the resins and naphthenic acids onto the surfaces of the solids renders significant surface activity to the solids, thus causing the emulsion to stabilize.

To break down the emulsions, it was determined that a decrease in solids attrition is beneficial. The use of a flocculant in the well stream before addition of a demulsifier is advantageous. Early removal of the surface active species further assists in breaking stable emulsions.

As discussed above, processes have been disclosed for effectively separating water from oil water emulsions. The disclosed process 100 is particularly useful when the well stream contains a water-in-oil emulsion that is stabilized with fine solids, as is found in some heavy oil production. The use of a flocculant in the well stream before addition of a demulsifier assists in later demulsification. The reduction of the fine mineral solids and solids-crude oil polars complexes increases the effectiveness of later water separation, and also enables the second separator 155 to operate at a lower temperature range, that is, lower than the more common range of 90° C. used in typical oil/water separators. Laboratory experiments examining the effect of temperature on solids flocculation and demulsification effectiveness can further aid in determining an optimum temperature for operation of each separator. While it will be apparent that the invention herein described is calculated to achieve the benefits and advantages set forth above, it will be appreciated that the invention is susceptible to modification, variation and change without departing from the spirit thereof.

What is claimed is:

1. A process for the separation of production fluids comprising an oil/water emulsion having stabilizing solids comprising:

subjecting an oil/water emulsion to a flocculating agent to flocculate solids within the oil/water emulsion, wherein subjecting the oil/water emulsion to the flocculating agent is conducted by injecting the flocculating agent into a wellbore;

separating water and solids in the oil/water emulsion from crude oil in a first separator;

subjecting the separated crude oil to a demulsifier after subjecting the oil/water emulsion to the flocculating agent; and separating additional water from crude oil in a second separator located at a surface facility.

2. The process of claim 1, wherein an operating temperature of the second separator is between about 25° C. and about 70° C.

3. The process of claim 1, wherein an operating temperature of the second separator is between about 50° C. and about 70° C.

4. The process of claim 1, wherein an operating temperature of the second separator is about 15° C. to about 50° C. below an operating temperature of the first separator.

5. The process of claim 1, wherein an operating temperature of the first separator is from about 25° C. to about 50° C.

6. The process of claim 1, wherein separating water and solids from crude oil in the first separator is conducted at the surface facility.

7. The process of claim 6, wherein subjecting the oil/water emulsion to the flocculating agent is further conducted by injecting the flocculating agent into a region of a hydrocarbon-bearing reservoir near the wellbore.

8. The process of claim 6, wherein:

the flocculating agent is delivered by an aqueous delivery medium; and the dosage of flocculating agent delivered into the wellbore is between about 20 parts per million (ppm) to about 2,000 ppm based on the weight of the aqueous delivery medium.

9. The process of claim 1, wherein:

subjecting the oil/water emulsion to the flocculating agent is further conducted by mixing the flocculating agent with the oil/water emulsion at the surface facility; and separating water and solids from crude oil in the first separator is conducted at the surface facility.

10. The process of claim 1, wherein subjecting the separated crude oil to the demulsifier comprises mixing the demulsifier into the separated crude oil before the separated crude oil enters the second separator.

11. The process of claim 1, wherein subjecting the separated crude oil to the demulsifier comprises mixing the demulsifier into the separated crude oil within the second separator.

12. The process of claim 1, wherein the flocculating agent is an inorganic salt.

13. The process of claim 1, wherein the flocculating agent is one of aluminum sulfate, ferric chloride and any mixtures thereof.

14. The process of claim 1, wherein the flocculating agent is one of a cationic polymer, an anionic polymer and any mixtures thereof.

15. The process of claim 1, wherein the flocculating agent is delivered by an aqueous delivery medium.

16. The process of claim 15, wherein:

subjecting the oil/water emulsion to the flocculating agent is further conducted by mixing the flocculating agent with the oil/water emulsion at the surface facility; and the dosage of flocculating agent is between about 5 parts per million (ppm) to about 1,000 ppm based on the weight of the oil/water emulsion.

17. The process of claim 1, wherein the demulsifier is comprised of one or more ethyleneoxy-propyleneoxy polymers as a demulsifier active ingredient.

18. The process of claim 17, wherein the demulsifier is selected from ethoxylated-propoxylated phenolformaldehyde resins and ethoxylated-propoxylated alcohols.

19. The process of claim 18, wherein the demulsifier is in the range from about 0.1 weight percent (wt. %) to about 5.0 wt. % based on the amount of the separated crude oil.

20. The process of claim 19, wherein a delivery solvent is mixed with the demulsifier before treating the separated crude oil.

21. The process of claim 20, wherein the delivery solvent comprises crude oil distillates boiling in the range of about 70° C. to about 450° C.

22. The process of claim 20, wherein the delivery solvent is selected from the group consisting of crude oil distillates, alcohols, ethers, or mixtures thereof.

23. The process of claim 20, wherein the delivery solvent is present in an amount of from about 35 wt. % to about 75 wt. % in the demulsifier, such weight percentage being included in the about 0.1 weight percent (wt. %) to about 5.0 wt. % demulsifier added to the separated crude oil.

24. The process of claim 20, wherein subjecting the separated crude oil to the demulsifier comprises mixing the demulsifier into the separated crude oil upon exiting the first separator.

25. The process of claim 1, wherein the operating pressure of the second separator is between ambient pressure and about 200 pounds per square inch gauge (about 1480.4 kilo Pascal).

26. The process of claim 1, wherein the stabilizing solids comprise at least one of formation fines, drilling muds and completion fluids.

27. The process of claim 26, wherein the solids comprise from about 0.01 weight percent (wt. %) to about 5.0 wt. % of the oil/water emulsion.

28. The process of claim 26, wherein the solids comprise fine solids with diameters from about 0.5 microns to about 100 microns.

29. The process of claim 26, wherein the solids comprise at least one of silica and clay.

30. The process of claim 26, wherein the solids comprise $BaSO_4$ or $CaCO_3$ introduced during an earlier drilling or workover operation.

31. The process of claim 1, wherein the first separator comprises at least one of a centrifugation separator, a gravity settling separator, a hydrocyclone, a separator that applies an electrostatic field, and a separator that applies microwave treatment.

32. The process of claim 1, further comprising processing the crude oil released from the second separator through a third separator.

33. The process of claim 32, wherein the third separator comprises at least one of a centrifugation separator, a gravity settling separator, a hydrocyclone, a separator that applies an electrostatic field, and a separator that applies microwave treatment.

34. The process of claim 1, wherein the oil/water emulsion contains dissolved inorganic salts of chloride, sulfates or carbonates of Group I and II elements of the long form of The Periodic Table of Elements.

35. The process of claim 1, wherein the oil/water emulsion is a water-in-oil emulsion.

36. The process of claim 35, wherein the crude oil is heavy crude oil.

37. The process of claim 36, wherein the oil/water emulsion also comprises one or more of asphaltenes, naphthenic acid compounds, resins, and mixtures thereof.

38. A process for producing fluids from a hydrocarbon-bearing reservoir comprising:

moving production fluids from a hydrocarbon-bearing reservoir into a wellbore and to a surface facility, the production fluids comprising a crude oil/water emulsion stabilized at least in part by solids;

subjecting the production fluids to a flocculating agent to flocculate solids within the crude oil/water emulsion, wherein subjecting the crude oil/water emulsion to the flocculating agent is conducted by injecting the flocculating agent into the wellbore;

separating water and solids in the crude oil/water emulsion from the crude oil in a first separator;

subjecting the separated crude oil to a demulsifier after the flocculating agent; and separating additional water from the separated crude oil in a second separator, the second separator operating in a temperature range of between about 25° C. and about 70° C.

39. The process of claim 38, wherein the operating temperature of the second separator is between about 50° C. and about 70° C.

40. The process of claim 38, wherein an operating temperature of the second separator is about 15° C. to about 50° C. below an operating temperature of the first separator.

41. The process of claim 38, wherein an operating temperature of the first separator is from about 25° C. to about 50° C.

42. The process of claim 38, wherein separating water and solids from the crude oil in the first separator is conducted at the surface facility.

43. The process of claim 42, wherein:

the flocculating agent is delivered by an aqueous delivery medium; and the dosage of flocculating agent delivered into the wellbore is between about 20 parts per million (ppm) to about 2,000 ppm based on the weight of the aqueous delivery medium.

44. The process of claim 38, wherein subjecting the crude oil/water emulsion to the flocculating agent is further conducted by mixing the flocculating agent with the crude oil/water emulsion at the surface facility.

45. The process of claim 38, wherein subjecting the separated crude oil to the demulsifier comprises mixing the demulsifier into the separated crude oil before the separated crude oil enters the second separator.

46. The process of claim 38, wherein the flocculating agent is an inorganic salt.

47. The process of claim 38, wherein the flocculating agent is one of a cationic polymer, an anionic polymer and any mixture thereof.

48. The process of claim 38, wherein the flocculating agent is delivered by an aqueous delivery medium.

49. The process of claim 48, wherein:

subjecting the crude oil/water emulsion to the flocculating agent is further conducted by mixing the flocculating agent with the crude oil/water emulsion at the surface facility; and the dosage of flocculating agent delivered into the wellbore is between about 5 parts per million (ppm) to about 1,000 ppm based on the weight of the crude oil/water emulsion.

50. The process of claim 38, wherein the demulsifier is comprised of one or more ethyleneoxy-propyleneoxy (EO-PO) polymers as a demulsifier active ingredient.

51. The process of claim 50, wherein the demulsifier is in the range from about 0.1 weight percent (wt. %) to about 5.0 wt. % based on the amount of the separated crude oil.

52. The process of claim 50, wherein a delivery solvent is mixed with the demulsifier.

53. The process of claim 52, wherein the delivery solvent is present in an amount from about 35 weight percent (wt. %) to about 75 wt. % in the demulsifier, such weight percentage being included in the 0.1 wt. % to 5.0 wt. % demulsifier added to the separated crude oil.

54. The process of claim 38, wherein the demulsifier is selected from ethoxylated-propoxylated phenolformaldehyde resins and ethoxylated-propoxylated alcohols.

55. The process of claim 38, wherein the stabilizing solids comprise at least one of formation fines, drilling muds and completion fluids.

56. The process of claim 55, wherein the solids comprise fine solids with diameters from about 0.5 microns to about 100 microns.

57. The process of claim 56, wherein the solids comprise at least one of silica and clay.

58. The process of claim 38, wherein the first separator comprises at least one of a centrifugation separator, a gravity settling separator, a hydrocyclone, a separator that applies an electrostatic field, and a separator that applies microwave treatment.

59. The process of claim 38, further comprising processing crude oil released from the second separator through a third separator.

60. The process of claim 59, wherein the third separator comprises at least one of a centrifugation separator, a gravity settling separator, a hydrocyclone, a separator that applies an electrostatic field, and a separator that applies microwave treatment.

61. The process of claim 38, wherein the crude oil/water emulsion contains dissolved inorganic salts of chloride, sulfates or carbonates of Group I and II elements of the long form of The Periodic Table of Elements.

62. The process of claim 38, wherein the crude oil/water emulsion is a water-in-oil emulsion.

63. The process of claim 62, wherein the crude oil is heavy crude oil.

64. The process of claim 63, wherein the production fluids further comprises one or more of asphaltenes, naphthenic acid compounds, resins, and mixtures thereof.

* * * * *